US005277123A

United States Patent [19]

Yang

[11] Patent Number: 5,277,123

[45] Date of Patent: Jan. 11, 1994

[54] ELECTROPLATING WORKPIECE HANGING BRACKET AUTOMATIC EXCHANGING DEVICE

[76] Inventor: Gwo-Tzeng Yang, No. 144-6, Chang Luh Road, Chang Hua, Taiwan

[21] Appl. No.: 726

[22] Filed: Jan. 5, 1993

[51] Int. Cl.[5] ..... B61B 3/00

[52] U.S. Cl. ..... 104/102; 104/88

[58] Field of Search ..... 104/102, 88, 89, 91, 104/96, 97, 127, 128, 129, 130, 137, 172.4; 198/680

[56] References Cited

U.S. PATENT DOCUMENTS

| | | | |
|---|---|---|---|
| 4,938,150 | 7/1990 | Gustav et al. | 104/102 |
| 4,991,515 | 2/1991 | Evenzon et al. | 104/102 |
| 5,119,732 | 6/1992 | Lisy | 104/91 |
| 5,154,123 | 10/1992 | Loomer | 104/102 |

FOREIGN PATENT DOCUMENTS

| | | | |
|---|---|---|---|
| 0287912 | 3/1991 | Fed. Rep. of Germany | 104/102 |
| 1549651 | 11/1968 | France | 104/102 |

*Primary Examiner*—Mark T. Le

*Attorney, Agent, or Firm*—Morton J. Rosenberg; David I. Klein

[57] ABSTRACT

The movable track of the automatic exchanging device is moved outward by hydraulic cylinders, letting the hanging bracket thereon, which is carried from a preceding process cycle, to be moved onto the rail of the conveying system of a proximate process cycle, so that another hanging bracket, which is carried on the rail of said proximate process cycle, is moved onto the movable track for shifting to the rail of said preceding process cycle.

1 Claim, 7 Drawing Sheets

ELECTROPLATING WORKPIECE HANGING BRACKET AUTOMATIC EXCHANGING DEVICE

BACKGROUND OF THE INVENTION

The present invention relates to an electroplating workpiece hanging bracket automatic exchanging device which automatically exchange an electroplating workpiece hanging bracket from one process cycle to another.

The process of electroplating is widely accepted in various industries, which covers mechanical parts or products thinly with silver by electrolysis. While electroplating, a workpiece must be treated through several process cycles. Automatic conveying systems are known and widely used in carrying workpieces in each process cycle by an electroplating workpiece hanging brackets. However, manual operation is still required in moving an electroplating workpiece hanging bracket from one process cycle to another.

SUMMARY OF THE INVENTION

The present invention has been accomplished to eliminate the aforesaid problem. It is therefore an object of the present invention to provide an electroplating workpiece automatic exchanging device which automatically moves an electroplating workpiece hanging bracket from one process cycle to another. According to the preferred embodiment of the present invention, an electroplating workpiece hanging bracket automatic exchanging device is generally comprised of a movable track fastened to a frame assembly and controlled to move forwards or backwards by hydraulic cylinders. When the movable track was extended out, the hanging bracket on the movable track, which is carried from a preceding process cycle, is moved onto the rail of the conveying system of a proximate process cycle, so that another hanging bracket, which is carried on the rail of the proximate process cycle, is moved onto the movable track for shifting to the rail of the preceding process cycle.

DETAILED DESCRIPTION OF THE PREFERRED EMBODIMENT

Figure 1:
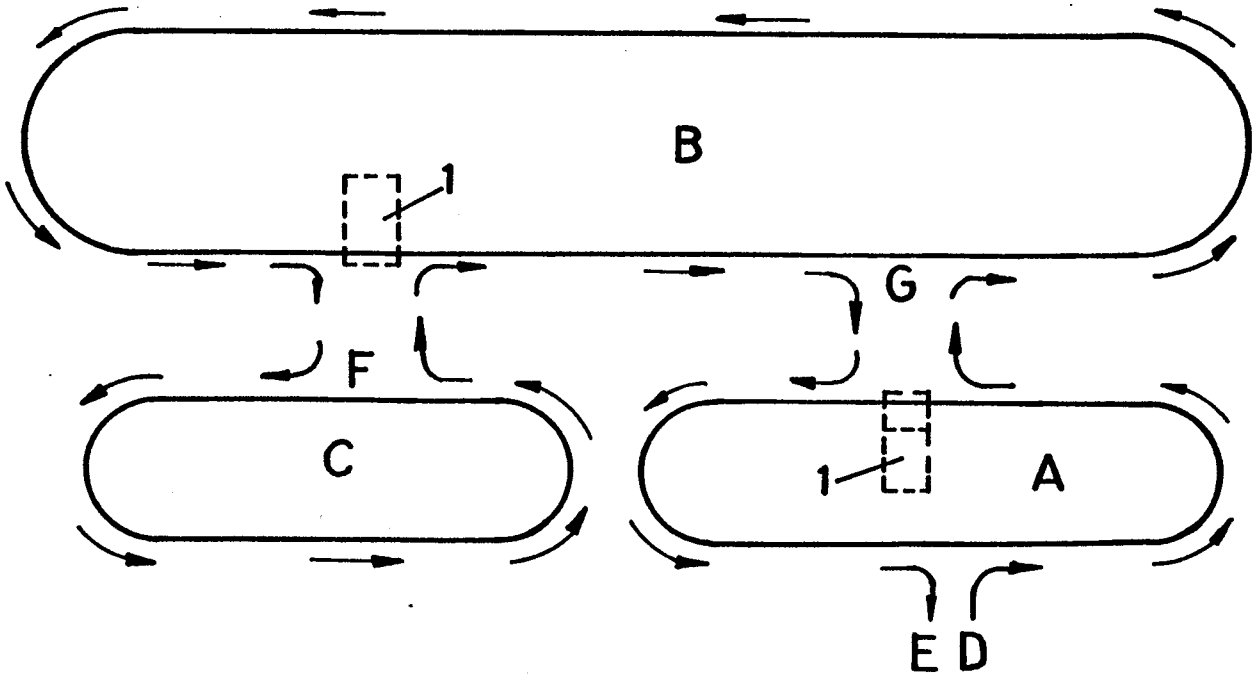
FIG. 1 illustrates the process cycles typically employed in electroplating.

Referring to FIG. 1, in the process of electroplating, a workpiece is treated through three process cycles A,B and C. Two electroplating workpiece hanging bracket automatic exchanging devices 1 are provided among the three process cycles so that an electroplating workpiece is automatically carried by an electroplating workpiece hanging bracket from one process cycle to another. The circulation of an electroplating workpiece through the three process cycles, is outlined hereinafter.

1. A workpiece is carried by an electroplating workpiece hanging bracket through entrance D into the first process cycle A for treatment;

2. The workpiece is carried by the electroplating workpiece hanging bracket and moved in counterclockwise direction toward the first electroplating workpiece hanging bracket automatic exchanging device;

3. The first electroplating workpiece hanging bracket automatic exchanging device moves the electroplating workpiece hanging bracket from the conveying system in the first process cycle A to the conveying system in the second process cycle B;

4. After the process through the second process cycle B, the electroplating workpiece hanging bracket is moved by the second automatic exchanging device to the third process cycle C for treatment;

5. After the process through the third process cycle C, the electroplating workpiece hanging bracket is moved to an exchanging spot F and shifted to the exchanging spot G between the second process cycle B and the first process cycle A;

6. At the final, the electroplating workpiece hanging bracket is shifted from the second process cycle B to the first process cycle by the first automatic exchanging device, and then, carried out of the first process cycle A through an exit E.

Figures 2, 2A:
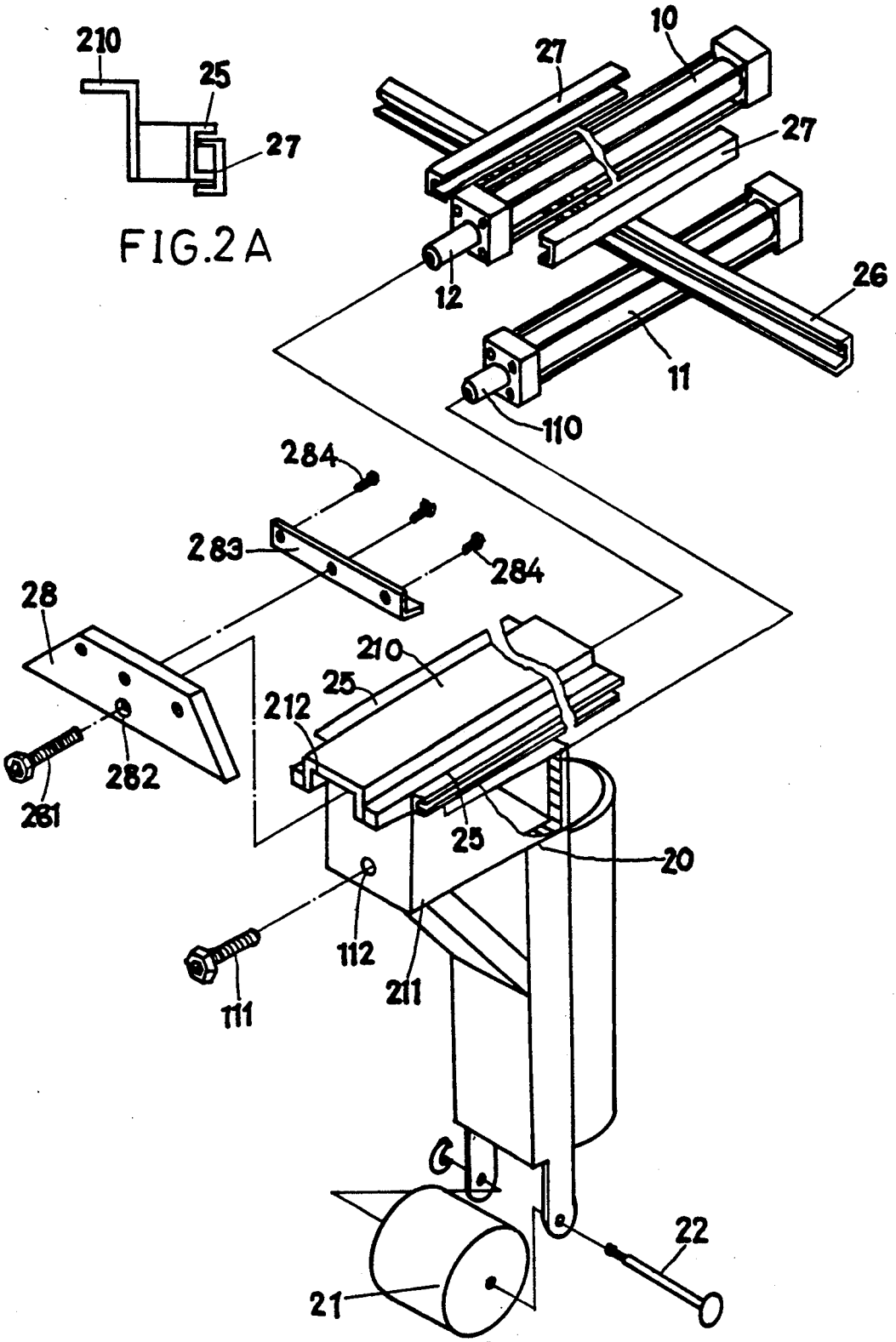
FIG. 2 is an exploded view of an electroplating workpiece hanging bracket automatic exchanging device according to the present invention.
FIG. 2A is a partly end view of the frame assembly showing the positioning of the top channel frame on the channel steels.

Referring to FIG. 2, an electroplating workpiece hanging bracket automatic exchanging device 1 is generally comprised of a first hydraulic cylinder 10, a second hydraulic cylinder 11, a frame assembly 20, and a track 28. The first and second hydraulic cylinders 10,11 are respectively fastened inside top channel mating frame 210, and bottom mating frame 211 of the frame assembly 20. A roller 21 is secured to the frame assembly 20 at the bottom by an axle 22. Therefore, the frame assembly 20 is stably supported on the roller 21 during its operation. The frame assembly 20 comprises two opposite channel steels 25 at the top respectively hung on two opposed channel steels 27 above a supporting frame 26 (see FIG. 2A). By means of the channel steels 25, the frame assembly 20 is stably moved forwards or backwards along the channel steels 27. The second hydraulic cylinder 11 has an internally threaded axle 110 at one end fixedly secured in a round hole 112 on the bottom mating frame 211 by a screw 111. The track 28 is made from a trapezoidal plate having a narrower top side and wider bottom side, and provided for hanging an electroplating workpiece hanging bracket. The first hydraulic cylinder 10 has an internally threaded axle 12 at one end fixedly secured in a hole 282 on the track 28 by a screw 281. An angle bar 283 is connected to the track 28 at one side by screws 284. The angle bar 283 has a bottom edge (not shown) welded to the top channel mating frame 210 of the frame assembly 20 at the top, permitting the track 28 to be stopped at an end edge 212 of the channel frame 20.

Figure 3:
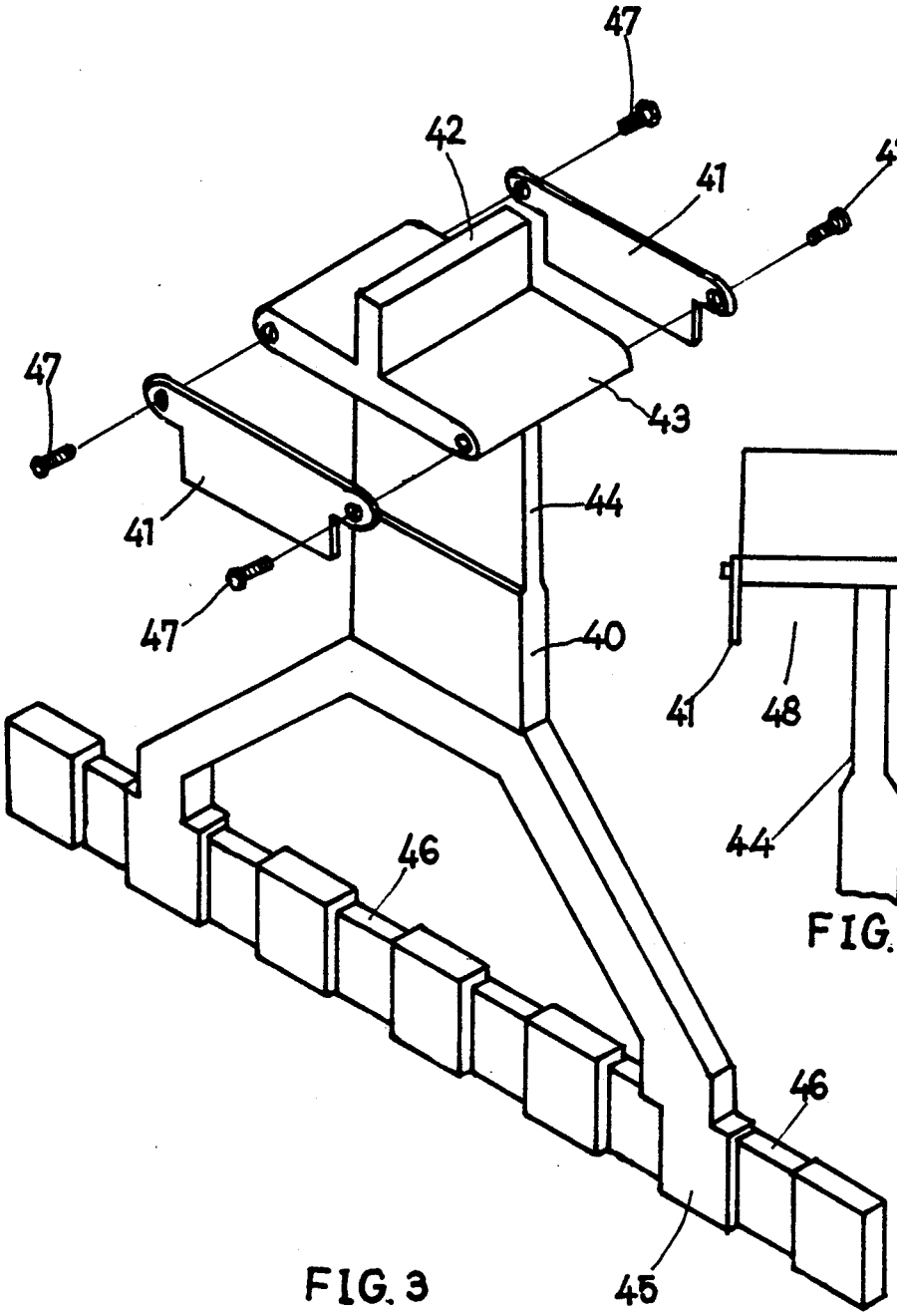
FIG. 3 is an exploded view of an electroplating workpiece hanging bracket according to the present invention.
Figure 3A:
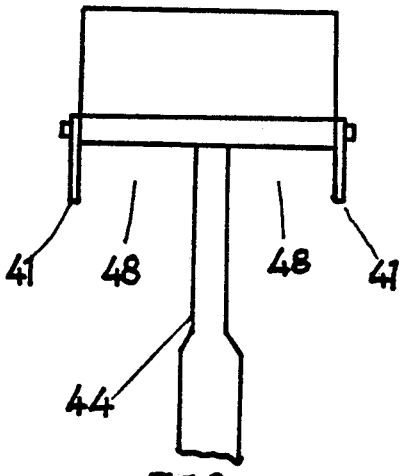
FIG. 3A is a plain end view of the electroplating workpiece hanging bracket of FIG. 3 showing that two channels are defined between the two guide plates and the stepped vertical wall.
Figure 4A:
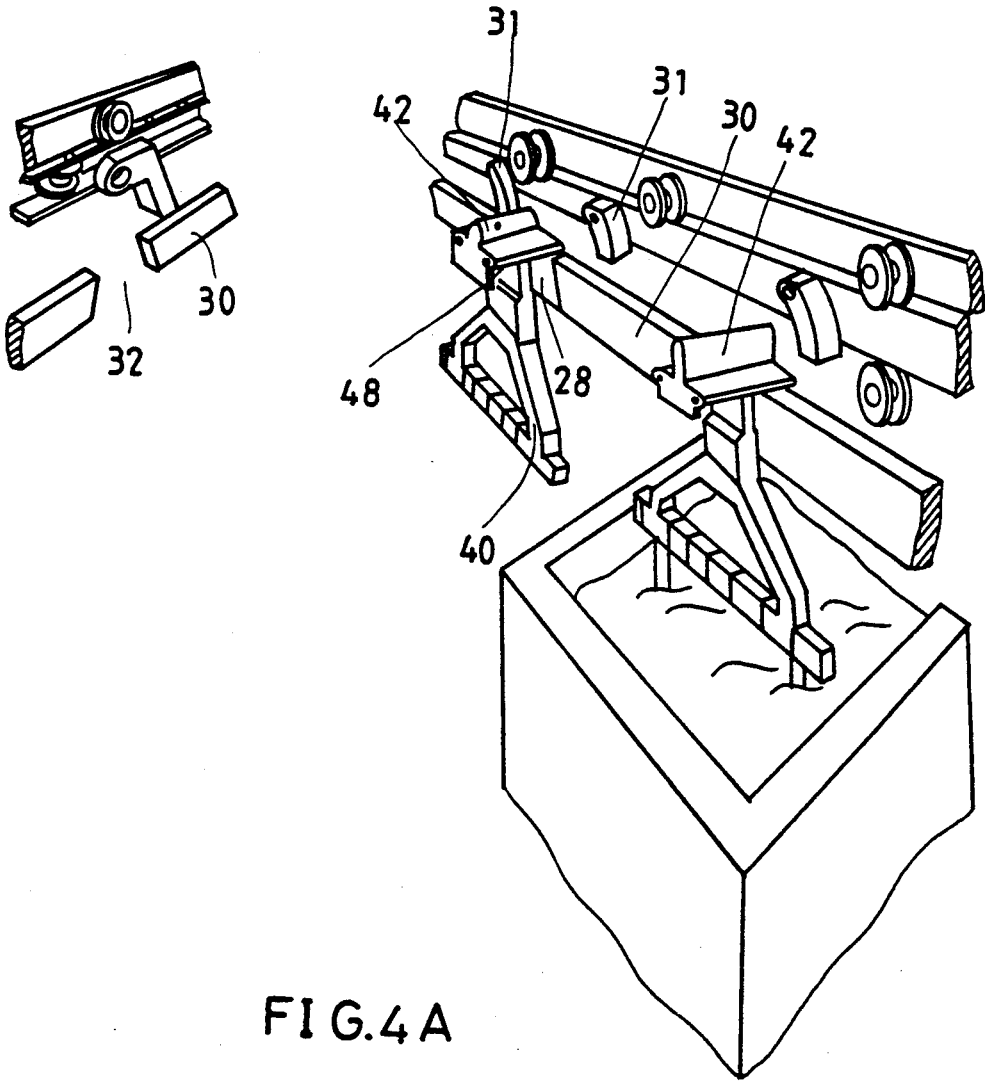
FIG. 4A illustrates that either channel of an electroplating workpiece hanging bracket is hung on the rail of the conveying system in one process cycle and pushed to move thereon by the pusher rods 31 of a transmission belt.
Figure 4B:
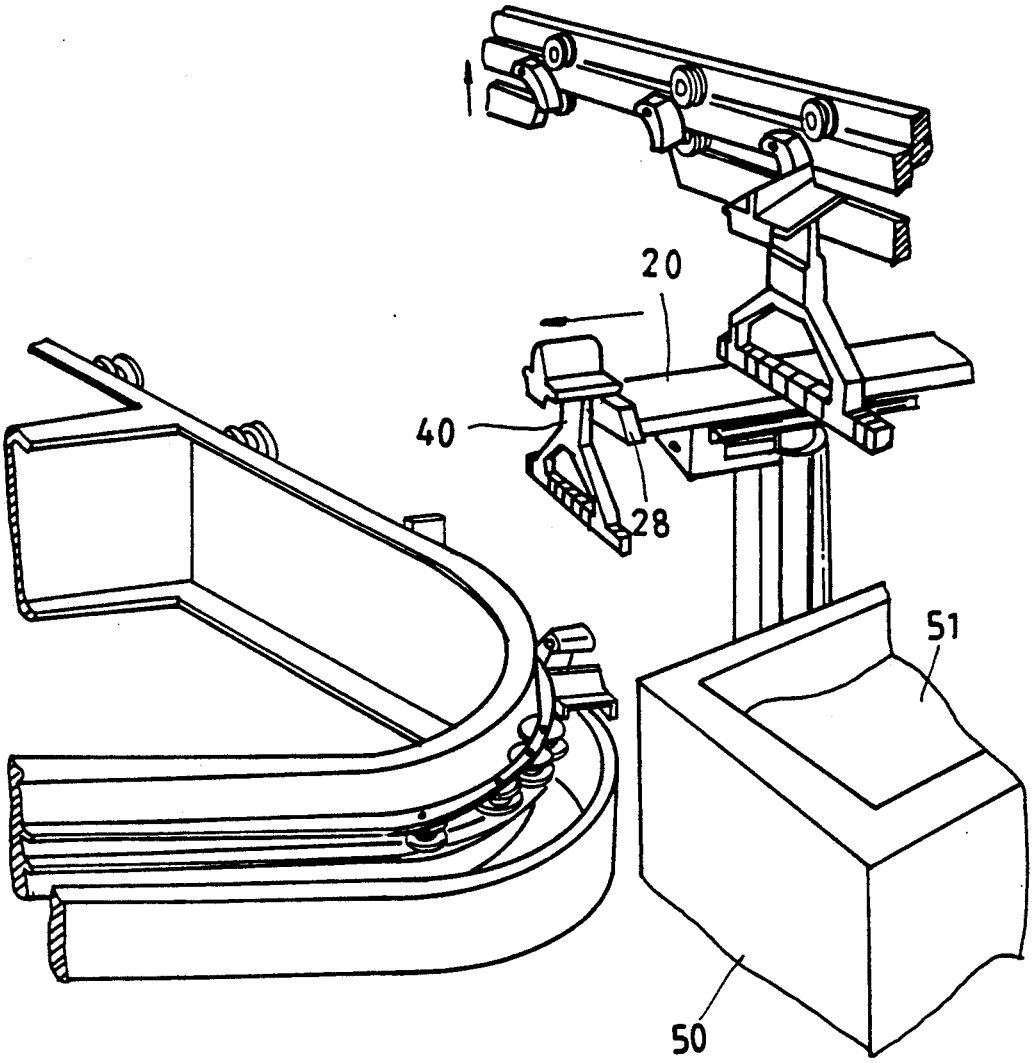
FIG. 4B illustrates that the electroplating workpiece hanging bracket has been lifted from the electroplating bath by the conveying system.
Figure 4C:
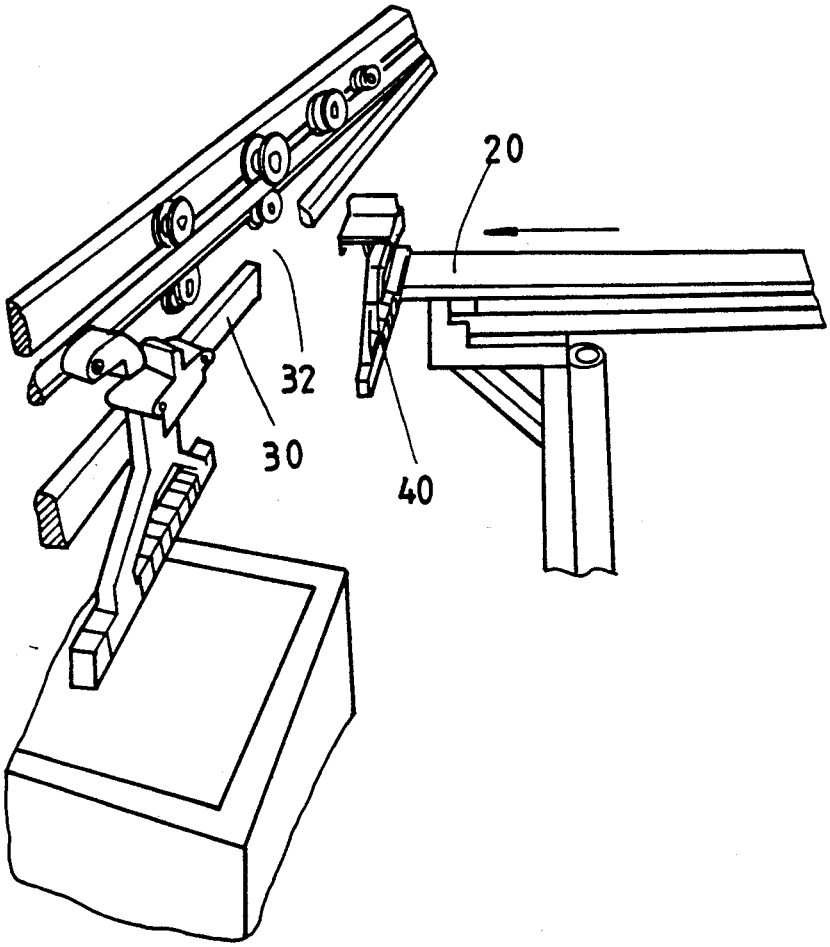
FIG. 4C illustrates that the first and second hydraulic cylinders are operated to extend out the frame assembly.
Figure 4D:
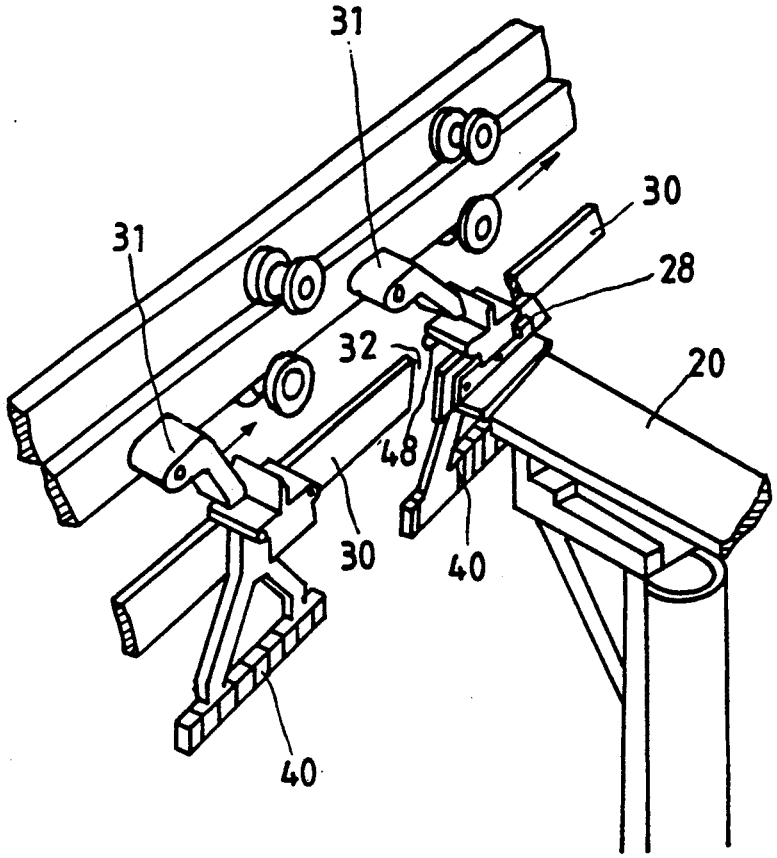
FIG. 4D illustrates that the frame assembly of the automatic exchanging device has been moved into the exchanging position in exchanging electroplating workpiece hanging brackets.

Referring to FIG. 3, an electroplating workpiece hanging bracket as constructed in accordance with the present invention is generally comprised of a hanging bracket 40 and two guide plates 41. The hanging bracket 40 comprises a T-shaped head 42,43 at the top, a transverse hanging bar 46 at the bottom, and a stepped vertical wall 40,44 connected therebetween. The transverse hanging bar 46 has spaced grooves 46 for hanging electroplating workpiece hangers. The guide plates 41 are respectively fastened to the transverse wall portion 43 of the T-shaped head of the hanging bracket 40 at two opposite sides by screws 47. Therefore, two channels 48 are formed between the upper wall portion 44 of the stepped vertical wall and the two guide plates 41 (see FIG. 3A). By means of the channels 48, the electroplating workpiece hanging bracket is hung to slide on the rail 30 of the mechanical conveying system in either process cycle.

The operation of the present invention is outlined hereinafter with reference to FIGS. 4A, 4B, 4C and 4D. Either channel 48 of the electroplating workpiece hanging bracket is hung on the rail 30 of the conveying system in one process cycle and pushed to move thereon by the pusher rods 31 of a transmission belt (see FIG. 4A). When a process cycle finished, the electroplating workpiece hanging bracket is moved to the track 28 of the electroplating workpiece hanging bracket of an automatic exchanging device for shifting to the rail of the conveying system in another process cycle. After having been treated by the electroplating solution 51 in the electroplating bath 50, the conveying system is moved upwards to lift the electroplating workpiece hanging bracket (see FIG. 4B). When lifted, the first and second hydraulic cylinders 10,11 are operated to extend out the frame assembly 20 (see FIG. 4C). When the frame assembly 20 has been extended out, the electroplating workpiece hanging bracket on the track 28 is moved onto the rail, and thereafter another electroplating workpiece hanging bracket is moved from the rail 30 onto the track 28 of the frame assembly 20. The first and second hydraulic cylinders 10,11 are then moved back to their original positions to return the frame assembly 20, so as to complete an exchanging operation.

What is claimed is:

1. An electroplating workpiece hanging bracket automatic exchanging device comprising:

a plurality of hanging brackets onto which electroplating workpieces are hung;

a frame assembly supported on a roller;

a movable track attached to a channel frame supported on said frame assembly;

two hydraulic cylinders fastened in said frame assembly and controlled to move said movable track forwards or backwards; and wherein said movable track is displaced from an initial positional location, for responsively moving a first hanging bracket thereon onto a first rail of a conveying system of a first process cycle, permitting a second hanging bracket to be moved from the first rail of the conveying system of said first process cycle to the movable track for carrying to a second rail of a conveying system of a second process cycle after said movable track has been displaced to said initial positional location, each of said hanging brackets having a pair of channel members for releasably coupling one of said pair of channel members in a displaceable manner onto a respective rail of a respective process cycle of said conveying system.

* * * * *